US006952878B1

(12) United States Patent
Bareis et al.

(10) Patent No.: US 6,952,878 B1
(45) Date of Patent: Oct. 11, 2005

(54) MOBILE SHEET MATERIAL CUTTING DEVICE

(76) Inventors: Kathryn M. Bareis, 4950 S. Lowes Creek Rd., Eau Claire, WI (US) 54701; Scott J. Maro, 110 Fourth Ave. SE.-Box 238, Gwinner, ND (US) 58040-0238

( * ) Notice: Subject to any disclaimer, the term of this patent is extended or adjusted under 35 U.S.C. 154(b) by 0 days.

(21) Appl. No.: 10/735,038

(22) Filed: Dec. 11, 2003

Related U.S. Application Data

(63) Continuation-in-part of application No. 10/108,033, filed on Mar. 26, 2002, now Pat. No. 6,684,512.

(51) Int. Cl.[7] ..... B26B 29/00
(52) U.S. Cl. ..... 30/294; 30/DIG. 3
(58) Field of Search ..... 30/293, 294, 286, 30/2, 340, DIG. 3

(56) References Cited

U.S. PATENT DOCUMENTS

| | | | | |
|---|---|---|---|---|
| 1,586,646 | A | 6/1926 | Belevin et al. | |
| 1,776,046 | A | 9/1930 | Schmidt | |
| 2,748,478 | A * | 6/1956 | Shelton | 30/289 |
| 3,613,241 | A * | 10/1971 | Allen | 30/294 |
| 4,549,351 | A | 10/1985 | Stanbery et al. | |
| 5,127,162 | A | 7/1992 | Mansfield | |
| 5,485,676 | A | 1/1996 | Terhorst | |
| 5,561,905 | A | 10/1996 | Sherman | |
| 5,715,605 | A | 2/1998 | Nadeau | |
| 5,737,842 | A | 4/1998 | Freedman | |
| 5,771,586 | A | 6/1998 | Lotarski et al. | |
| 5,881,463 | A | 3/1999 | Casteel et al. | |
| 6,484,404 | B1 | 11/2002 | Kao | |
| 2003/0115760 | A1 | 6/2003 | Martinez | |

* cited by examiner

*Primary Examiner*—Douglas D Watts
(74) *Attorney, Agent, or Firm*—Anthony J. Bourget

(57) ABSTRACT

A self-standing mobile device for cutting sheet material including a body member connected to at least one wheeled axle to translationally move the body member about a surface on which the device self-stands. The body member includes a cutting notch with open and closed ends, the cutting notch positioned with the open end above the at least one wheeled axle. The body member including a contained cutting blade member with cutting edge exposed within the cutting notch closed end, the cutting blade member oriented substantially perpendicularly to the surface on which the device self-stands. A user may engage the device to move the device about the surface on the at least one wheeled axle to cut a sheet of material passing into the cutting notch. Handle and shoulder features, and related methods of cutting sheet material are also disclosed.

35 Claims, 15 Drawing Sheets

MOBILE SHEET MATERIAL CUTTING DEVICE

CROSS-REFERENCE TO RELATED APPLICATIONS, IF ANY

This is a continuation-in-part of U.S. patent application Ser. No. 10/108,033, filed on Mar. 26, 2002, now U.S. Pat. No. 6,684,512, which is hereby incorporated by reference as if fully reproduced herein.

BACKGROUND OF THE INVENTION

1. Field of the Invention

The present invention relates generally to a device for cutting sheet material, and more specifically, to a mobile device with an easily engaged handle for cutting sheet material, such as paper.

2. Background Information

Cutting with scissors requires dexterity involving fine motor skills. Young children often encounter difficulties in handling and operating a scissors for cutting sheet material, such as paper. Likewise, individuals with certain physical disabilities and those with limited mental capabilities often encounter difficulties in using a scissors.

Some examples of inventions concerned with cutting devices for which patents have been granted are found in the following: Mansfield, U.S. Pat. No. 5,127,162; Sherman, U.S. Pat. No. 5,561,905; Nadeau, U.S. Pat. No. 5,715,605; Freedman, U.S. Pat. No. 5,737,842; and Casteel et al., U.S. Pat. No. 5,881,463. One prior art device is shown in FIGS. 14 and 15 herein, which relates to what may sometimes be considered a paper and coupon cutter device ("coupon cutter"). The coupon cutter 200 includes a structure 202 having a gap 204 into which paper (not shown) may be inserted for cutting with a blade 206 exposed toward an inward portion 208 of the gap 204. A user may hold the structure at a handle 210 to move cutter 200 in the direction marked with the arrow "A" toward the paper to be cut. A slot 212 is provided in the structure 202 for insertion of the blade 206 which may be retracted with slider 214. Structure 202 and base 216 define the gap 204. Structure 202 includes an aperture 218 to assist in holding the cutter. As further shown in FIG. 15, a front view shows cutter 200 having a generally uniform thickness which is also substantially narrower than its height. Structure 202 and base 216 are of substantially the same width.

However, these disclosed devices require a minimum degree of dexterity in their operation. Thus, there is an unmet need for a sheet material cutting device that can be used by young individuals or those with limited physical or mental capabilities. The device of the present invention meets this need, while providing many additional features that are unique to the structure described herein.

SUMMARY OF THE INVENTION

The present invention is directed to a mobile device for cutting sheet material. The device includes a self-standing mobile device for cutting sheet material including a body member connected to at least one wheeled axle to translationally move the body member about a surface on which the device self-stands. The body member includes a cutting notch with open and closed ends, the cutting notch positioned with the open end above the at least one wheeled axle. The body member including a contained cutting blade member with cutting edge exposed within the cutting notch closed end, the cutting blade member oriented substantially perpendicularly to the surface on which the device self-stands. A user may engage the device to move the device about the surface on the at least one wheeled axle to cut a sheet of material passing into the cutting notch.

In a further aspect the device includes a self-standing mobile device for cutting sheet material having a body member including a cutting notch with open and closed ends and including a contained cutting blade member with cutting edge exposed within the cutting notch closed end. The cutting blade is oriented substantially vertically within the body member. A shoulder is positioned below the body member, the shoulder in part defining the notch. The shoulder is translationally moveable about a surface on which the device self-stands. A handle is secured to the device, the handle extending upwardly opposite the surface. The handle and body member form a grasping notch therebetween, whereby a user engages the handle to move the body member about the surface to cut a sheet of material passing into the cutting notch. The device self-stands through the translational movement.

In another aspect, the rolling support means includes wheeled axles positioned in a plane and oriented perpendicularly to the vertical planar body member. The planar body member includes a cutting notch with open and closed ends with the notch open end positioned adjacent and above the rolling support means. The planar body member includes a contained cutting blade member with a cutting edge exposed within the cutting notch closed end. A handle member is secured to, and coplanar with, the planar body member, with the handle member extending upwardly, opposite the rolling support means. The handle member and planar body member form a grasping notch there between, whereby a user grasps the handle member and rolls the planar body member forward on the rolling support means to cut a sheet of material passing into the cutting notch.

The above summary of the present invention is not intended to describe each illustrated embodiment or every implementation of the present invention. The figures and detailed description that follow more particularly exemplify these embodiments.

BRIEF DESCRIPTION OF THE DRAWINGS

The invention may be more completely understood in consideration of the following detailed description of various embodiments of the invention in connection with the accompanying drawings, in which.

Figure 1:
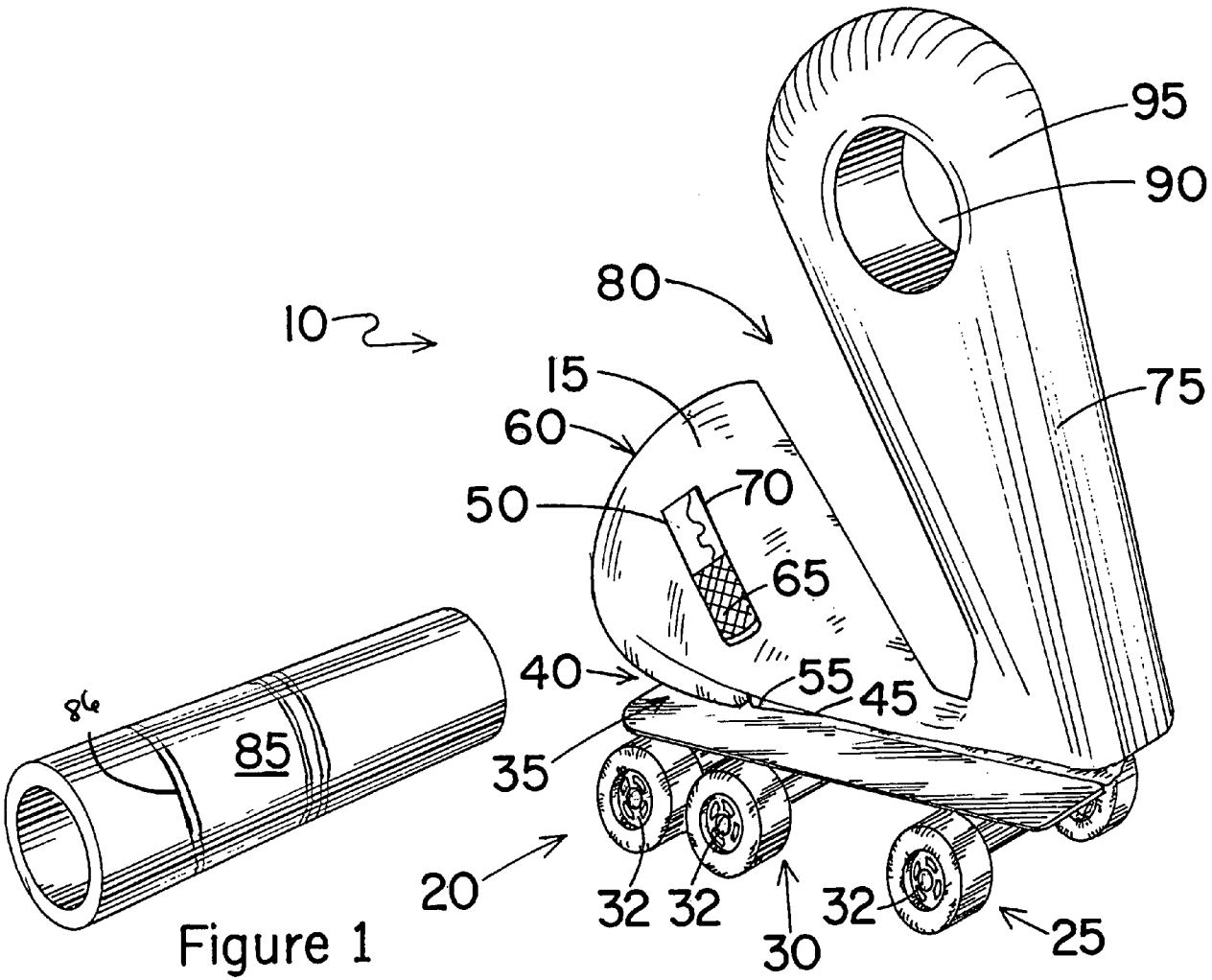
FIG. 1 shows a perspective view of the mobile cutting device and separate linear crossbar member of one embodiment of the present invention.

While the invention is amenable to various modifications and alternative forms, specifics thereof have been shown by way of example in the drawings and will be described in detail. It should be understood, however, that the intention is not necessarily to limit the invention to the particular embodiments described. On the contrary, the intention is to cover all modifications, equivalents, and alternatives falling within the spirit and scope of the invention, as defined by the appended claims.

DESCRIPTION OF THE EMBODIMENTS

The present invention is directed to a mobile device for cutting sheet material, including a planar body member supported vertically on rolling support means for translational movement of the device on a support surface. In one embodiment, the rolling support means includes wheeled axles positioned in a plane and oriented perpendicularly to the vertical planar body member. Other rolling support means, such as track-type supports, rollers, or contained spheres, can be secured to the planar body member with equivalent results. The planar body member includes a cutting notch with open and closed ends, with the notch open end positioned adjacent and above the rolling support means. The planar body member also includes a contained cutting blade member with a cutting edge exposed within the cutting notch closed end. A handle member is secured to, and coplanar with, the planar body member, with the handle member extending upwardly, opposite the rolling support means. The handle member and planar body member form a grasping notch there between. A user grasps the handle member and rolls the planar body member forward on the rolling support means to cut a sheet of material passing into the cutting notch.

Further aspects or embodiments of the invention are described in more detail throughout the following specification and claims.

Referring to FIGS. 1–5, several embodiments of the wheeled device for cutting sheet material of the present invention is shown. The wheeled cutting device 10 includes a planar body member 15 supported vertically on a rolling support means, such as a front wheeled axle 20 and a rear wheeled axle 25. The wheeled axles 20, 25 are oriented perpendicularly to the vertical planar body member 15 and are positioned in a plane so that the wheels 32 contact a flat surface to provide stable support for the vertical planar body member 15. In a further embodiment of the invention, a third wheeled axle 30 is secured perpendicularly to the vertical planar body member 15, adjacent the front wheeled axle 20 and coplanar therewith, to provide additional stability in supporting the vertical planar body member 15. The Figures show all three wheeled axles 20, 25, 30 present and in a common plane.

The planar body member 15 includes a cutting notch 35 with an open end 40 and a closed end 45, with the notch 35 positioned adjacent the front wheeled axle 20 and the notch open end 40 forward of the front wheeled axle 20. Preferably, the cutting notch 35 is essentially parallel to the plane of the wheeled axles 20, 25.

The planar body member 15 also includes a contained cutting blade member 50 with a cutting edge 55 exposed within the cutting notch closed end 45. The cutting blade member 50 is preferably positioned on a centerline of the planar body member 15. The planar body member 15 contains a blade slot 60 that accepts and secures the cutting blade member 50 within the body member 15. The blade slot 60 intersects the cutting notch 35 so as to position the blade cutting edge 55 at the cutting notch closed end 45. Preferably, the blade cutting edge 55 is angled in the cutting notch 35 from the open end 40 toward the closed end 45. As the sheet material rides on the edges of the cutting notch 35, the sheet is supported as the angled cutting edge 55 moves through the material. The blade member 50 is preferably secured to a sliding blade positioner 65 that moves in a linear slot 70 in the body member 15 to assist in inserting and removing the blade member 50 from the blade slot 60. The blade member 50 is preferably a single or double-edged razor blade that is readily available at retail outlets. The blade member 50 is completely contained within the body member 15, so that only a small portion of the cutting edge 55 is exposed at the cutting notch closed end 45, thereby preventing dangerous exposure of the blade cutting edge 55 during use.

Figure 2:
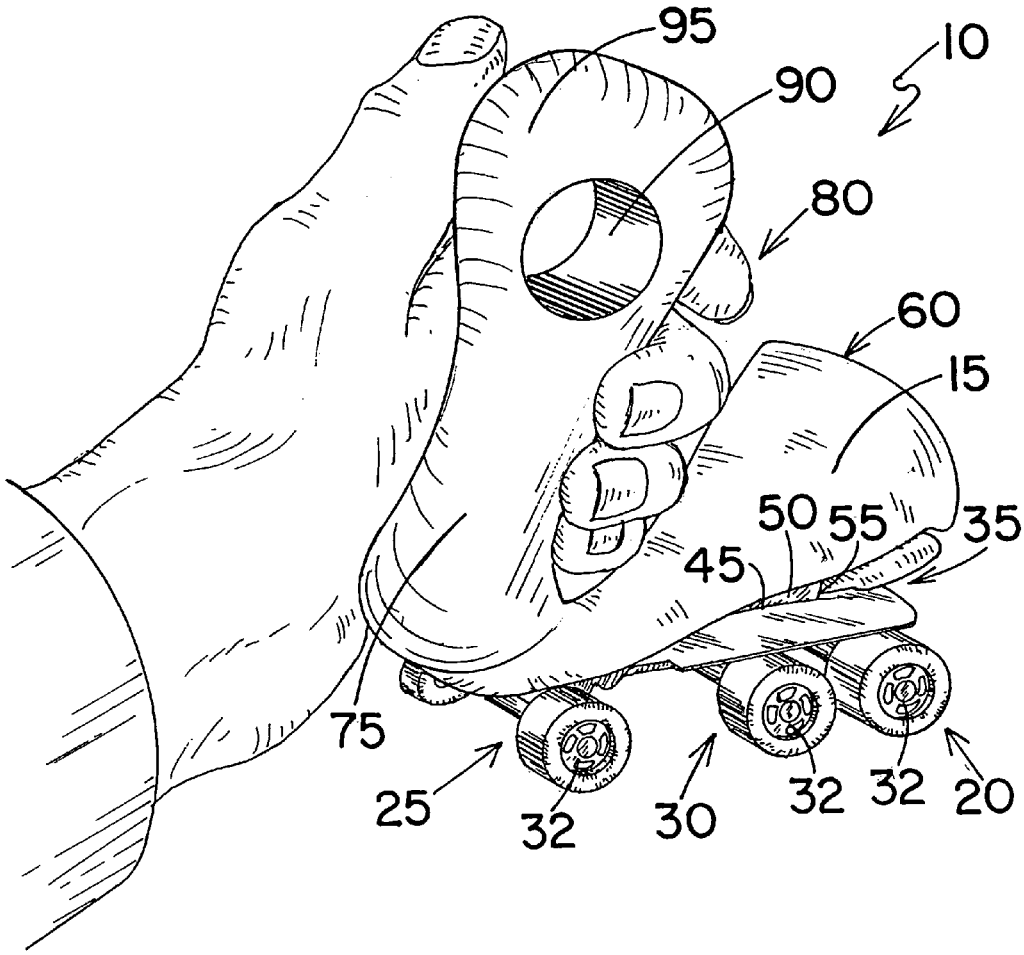
FIG. 2 shows a perspective view of a user grasping the handle of the mobile cutting device for one embodiment of the present invention.
Figure 3:
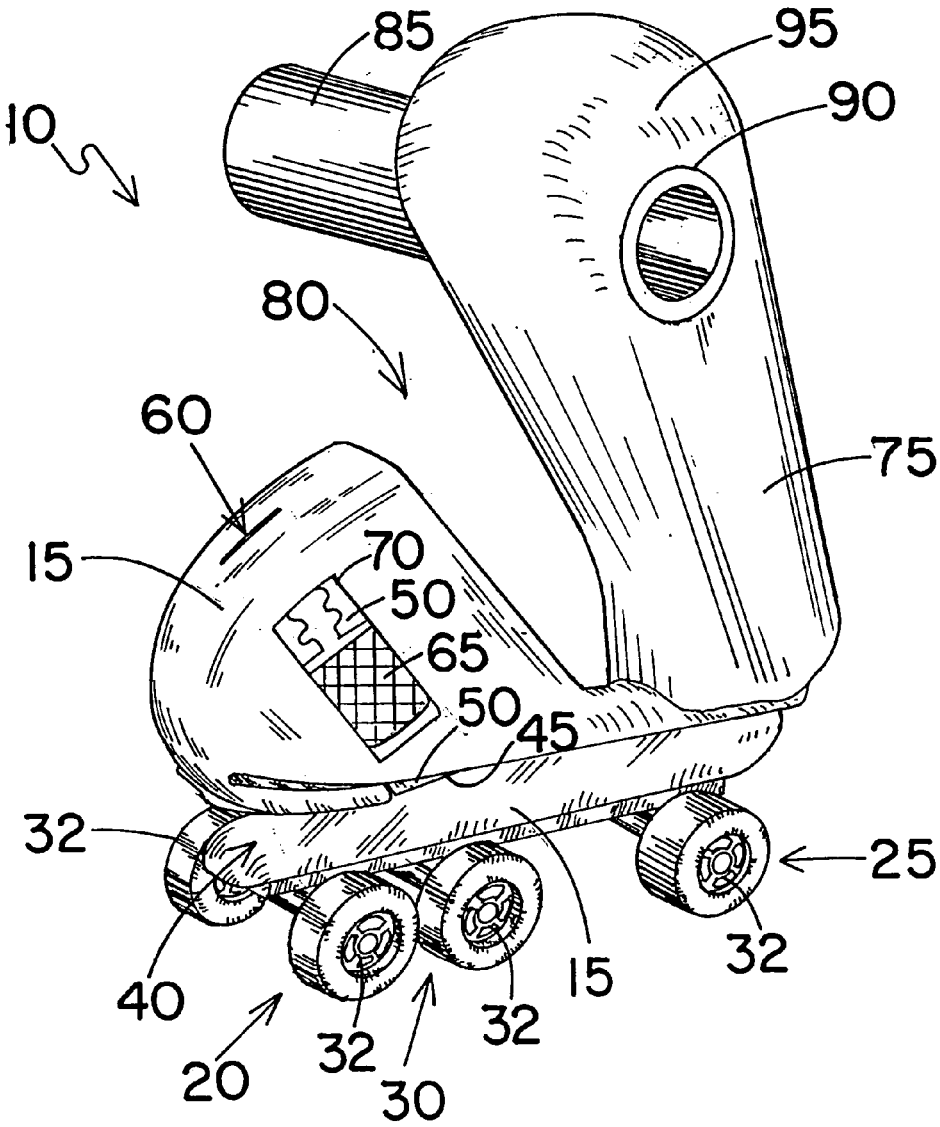
FIG. 3 shows a perspective view of the mobile cutting device with a linear crossbar member installed for another embodiment of the present invention.
Figure 4:
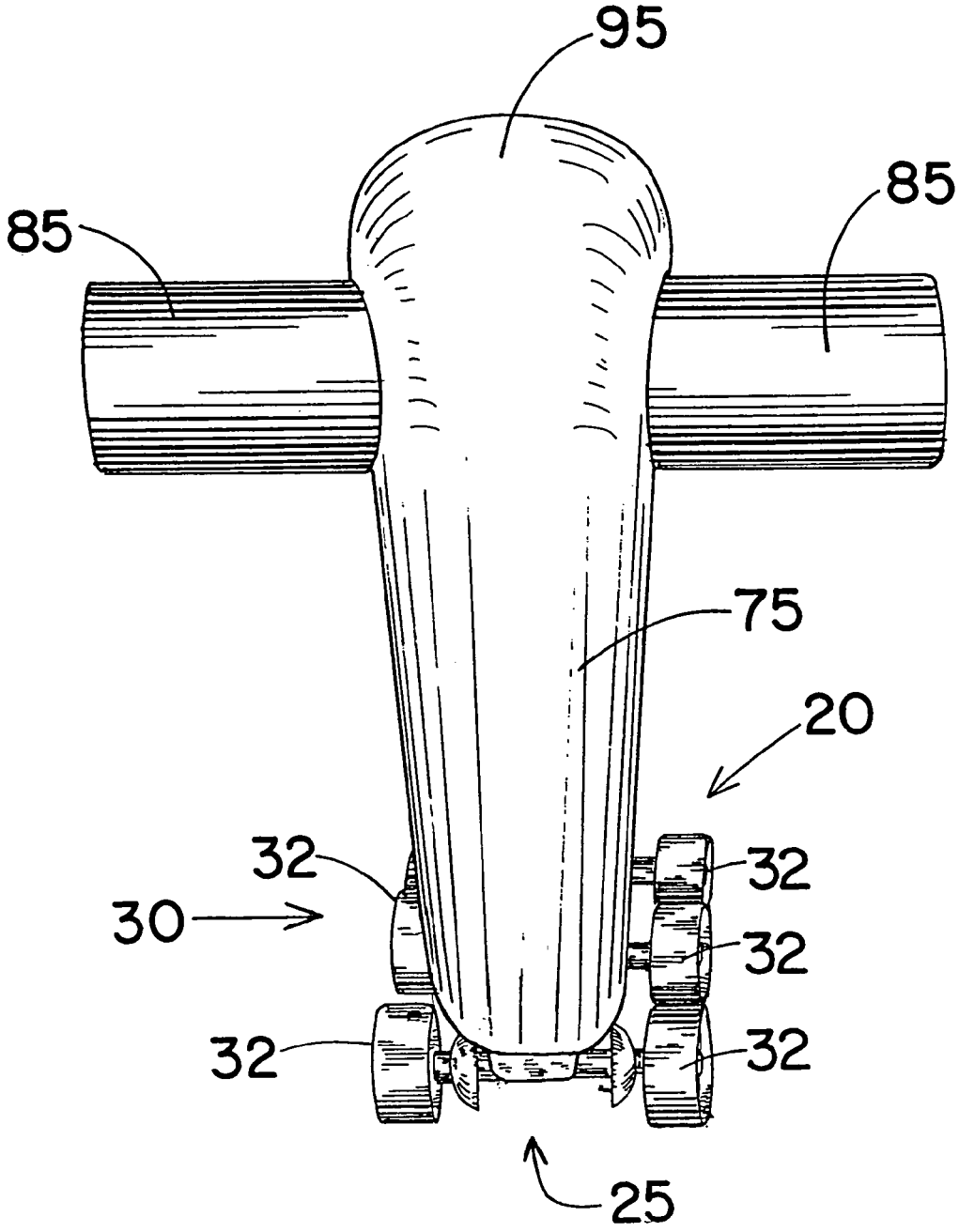
FIG. 4 shows a rear view of the mobile cutting device with a linear crossbar member installed for another embodiment of the present invention.
Figure 5:
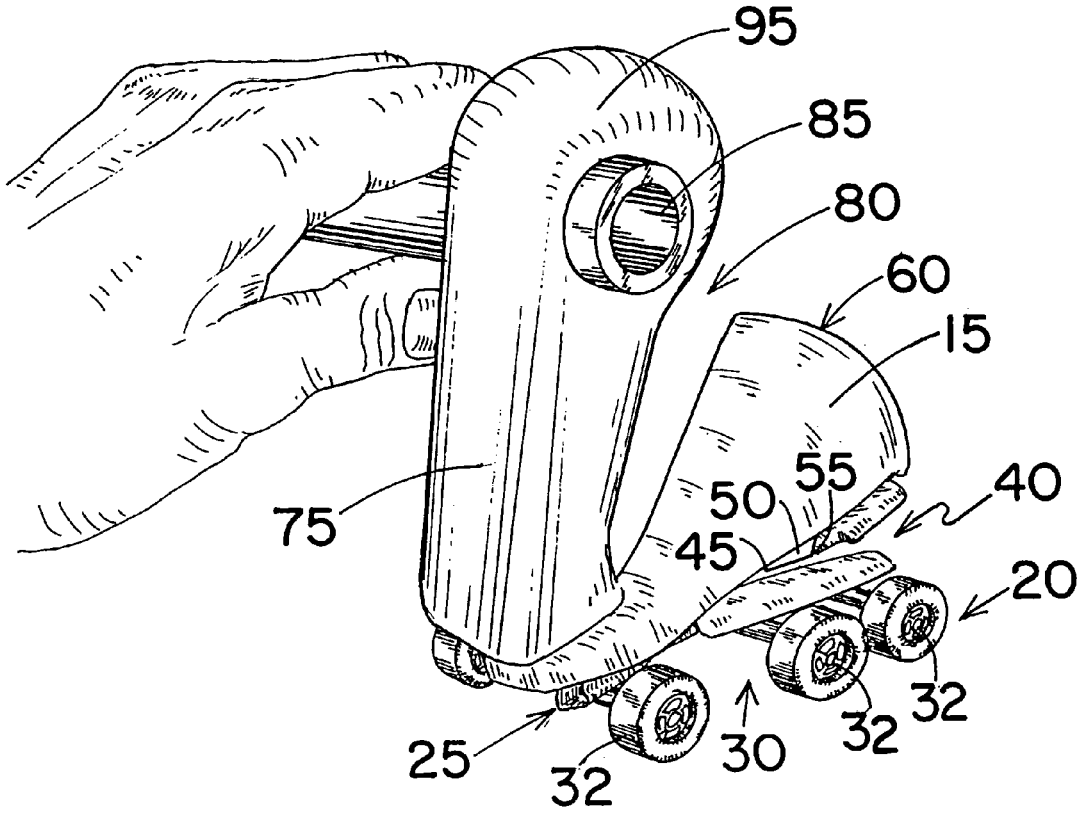
FIG. 5 shows a perspective view of a user grasping the linear crossbar member secured to the mobile cutting device for another embodiment of the present invention.

A bulbous handle member 75 is secured to, and coplanar with, the planar body member 15, with the handle member 75 extending upwardly opposite the rear wheeled axle 25. The handle member 75 and the planar body member 15 form a grasping notch 80 there between. As illustrated in FIG. 2, a user grasps the bulbous handle member 75, with the user's fingers in the grasping notch 80, and rolls the planar body member 15 forward on the wheeled axles 20, 25, 30, to cut a sheet of material passing into the cutting notch 35 by the cutting edge 55 exposed therein. Preferably, the handle member 75 is inclined away from vertical and toward the front wheeled axle 20, forming an angle of about 70 degrees with the plane of the wheeled axles 20, 25, 30.

In a further embodiment of the invention, a linear crossbar member 85 is positioned perpendicularly to the planar body member 15 in an aperture 90 in the bulbous handle member aperture 90 to provide an easily grasped appendage for the handle member 75. Most preferably, the aperture 90 and linear crossbar member 85 are positioned near an end 95 of the bulbous handle member 75 opposite the rear wheeled axle 25. The linear crossbar member 85 is preferably cylindrical and the aperture 90 is round, for ease of insertion and removal, although other geometrical shapes are contemplated for both the crossbar member 85 and the aperture 90. The linear crossbar member 85 slides within the aperture 90 so that the crossbar member 85 can be extended to either side of the handle member 75, at the discretion of the user. Similarly, the crossbar member 85 can be completely removed from the aperture 90, if the user desires.

The bulbous handle member 75 thus provides an easily grasped portion of the wheeled cutting device 10. The linear crossbar member 85 secured to the handle member 75 provides an additional easily grasped portion, allowing the user many choices for holding and operating the cutting device 10.

Referring to FIGS. 6–11, further embodiments of the present invention are shown. It may be appreciated that the following may include, among many of the other features, rolling support means for movement of the cutting device on a surface, as mentioned above. In addition thereto, cutting device 10 is not limited to the features previously described, and it may be appreciated that cutting device 10 may include those aspects of self-standing cutting device 110 hereafter described.

Figure 6:
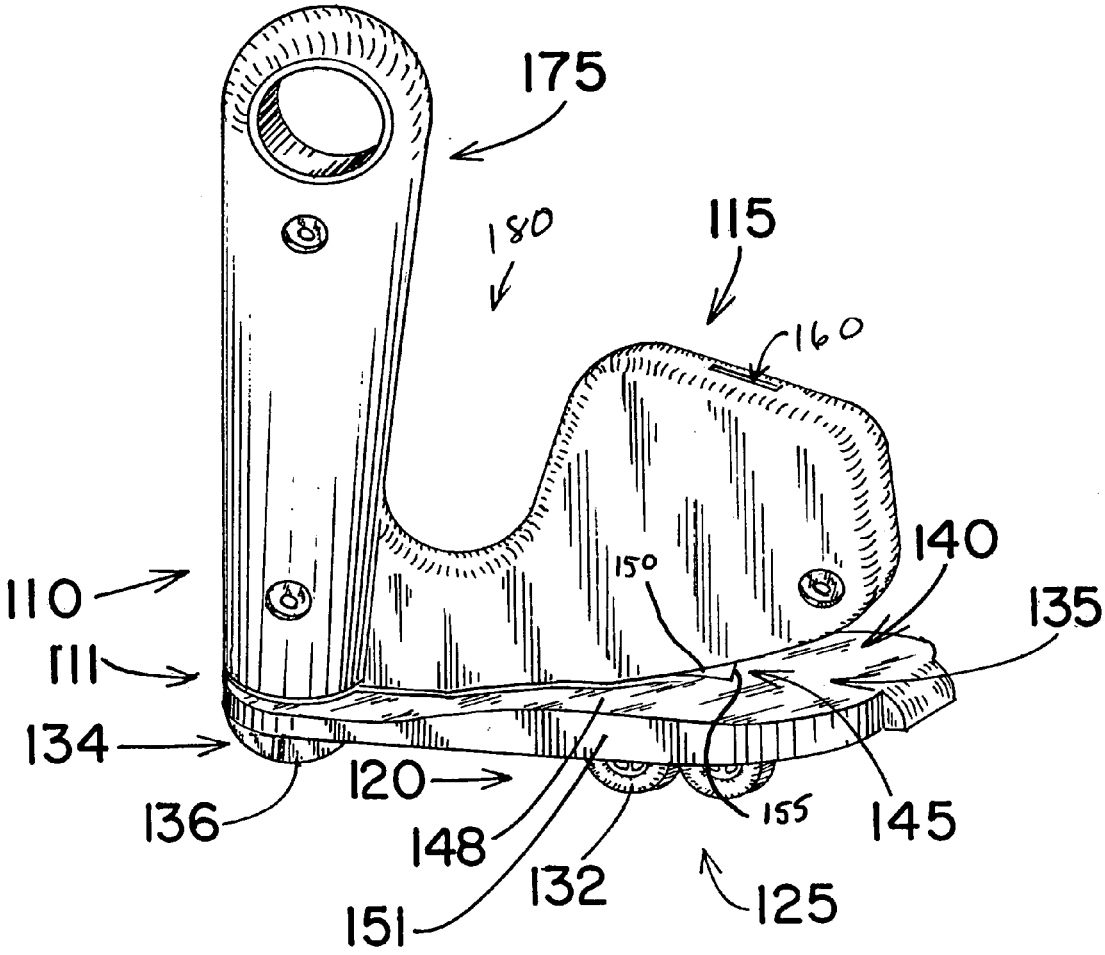
FIG. 6 shows a perspective view of the mobile cutting device for another embodiment of the present invention.

Self-standing mobile cutting device 110 includes a body member 115 in connection to at least one wheeled axle 120 as shown if FIG. 6 (and as appreciated in related FIGS. 1–5). Axle 120 supports at least one wheel 132 in common fashion, which translationally moves body member 115 about a surface on which the device 110 self-stands. Axle 120 may include a pair of opposing wheels 132 on either end of axle 120. Body member 115 includes cutting notch 135 with open end 140 and closed end 145. Cutting notch 135 is positioned with the open end 140 positioned above the at least one wheeled axle 120. A contained cutting blade member 150 is included within the body member 115. Blade slot 160 allows for selective entry and removal of blade 150 from member 115. Cutting edge 155 of blade 150 is exposed within the cutting notch closed end 145 to provide enhanced safety. Notch 135 is preferably tapered to provide further protection of blade 150 while allowing ease of insertion of sheet material to be cut. Cutting blade 150 is oriented substantially perpendicularly to a surface (surface not shown) on which the device 110 self-stands. In operation a user engages device 110 to move the device 110 about the surface on the wheeled axle 120 to cut a sheet of material passing into the cutting notch 135. Having blade 150 positioned vertically with respect to a surface upon which device 110 self-stands allows a user to experience cutting sheet material without the need for having to hold or grasp the device or otherwise make a typical scissors-type of operation. A user may engage the device in any number of ways, including with the placement of a finger or hand on the device to move it forward in a cutting fashion. While a user may also grasp the device 110, it may be appreciated that a user may simply engage the device by use of a finger, other body part or head-pointer (or like item) to operate movement of the device 110. The self-standing device allows a user to cut sheet material without having to grasp or otherwise control the device from tipping-over such that the cutting blade is not oriented substantially perpendicular to a sheet to be cut.

Figure 10:
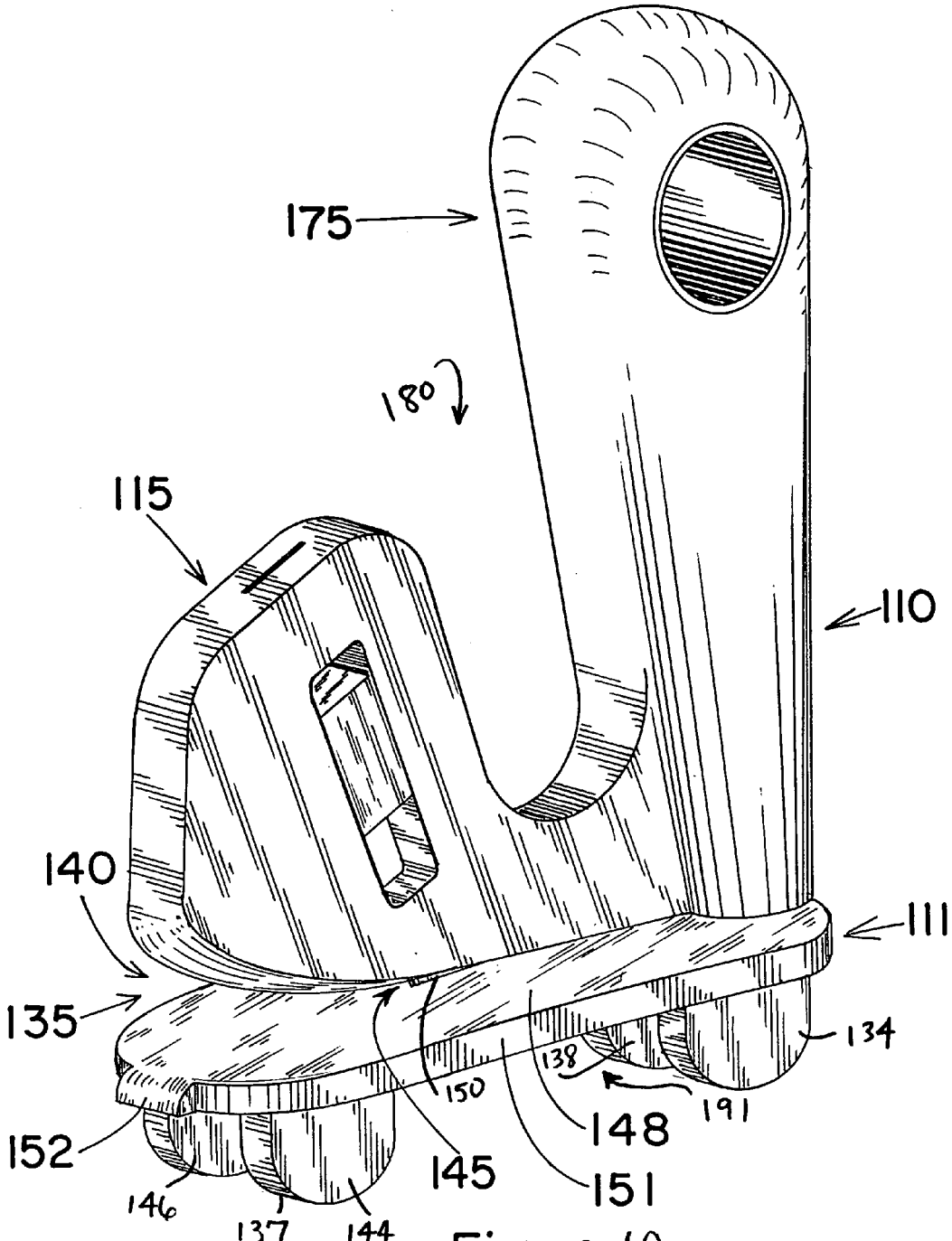
FIG. 10 shows a perspective view of the mobile cutting device for another embodiment of the present invention.
Figure 11:
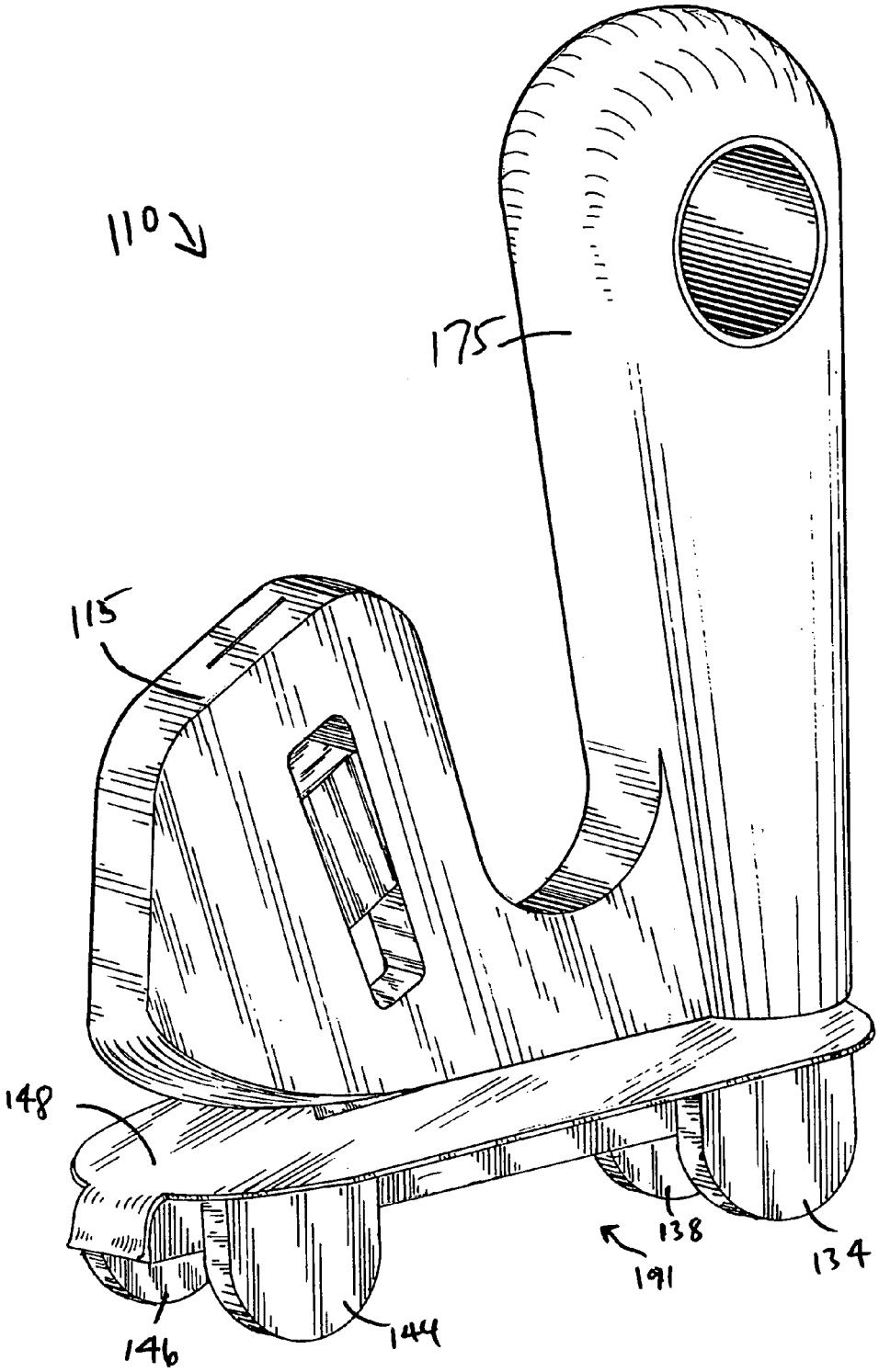
FIG. 11 shows a perspective view of the mobile cutting device for another embodiment of the present invention.

Preferably body member 115 is substantially planar and oriented substantially perpendicular to the surface so that when in use device 110 may cut flat sheet material, such as paper, felt or other such materials which are generally aligned parallel with the surface. At least an additional wheeled axle 125 may be included to assist in self-standing stability and translational movement about the surface. Axles 120, 125 preferably align in a common plane and such that connected wheels 132 engage a flat surface upon which device 110 self-stands on a flat surface without external support. It may be appreciated that device 110 includes both a wheeled axle 20 and at least one surface-contacting slider 134 positioned below the cutting notch 135. It may be appreciated in further embodiments such as shown in FIGS. 10, 11, that device 110 includes a slider 134 without use of a wheeled axle for support and translational movement about a surface.

As shown in FIG. 6, slider 134 positioned toward a rear-end 111 of device 110 assists a user with rear-end maneuverability of the device 110 in order to better create curved cuttings as desired. It may be appreciated that more than one slider 134 may be provided. Preferably slider 134 is configured to contact the surface at a single rounded point at end portion 136. Preferably wheels 132 and the end portion 136 of slider 134 are aligned in a common plane for stable engagement with a flat surface. It may be appreciated that slider 134 may instead be configured with a rounded contact line 137 (see for instance, FIG. 10). In the further embodiments of FIGS. 10, 11, multiple slider 134 configurations can be employed to achieve similar stability and translational results. It may be appreciated that self-standing aspects of the device 110 may be achieved by using a combination of wheeled axles 120, 125 and slider 134 configurations.

Preferably device 110 includes shoulder 148 positioned below body member 115. Shoulder 148, in part with body member 115, defines the cutting notch 135. Shoulder 148 has shoulder edges 149 which extend outward from device 110 to urge the sheet to lay substantially flat when passed through notch 135 to ease in cutting. Shoulder 148 having a width greater than a width of the body member 115 allows for further horizontal and lateral support of the paper during and after cutting, and reduces friction or sticking of the paper. Shoulder 148 reduces paper sag after being cut to preferably maintain paper at a flat position. Shoulder 148 with edges 149 also provides a width greater than a width of the body member 115 to increase self-standing stability of device 110. Preferably, wheeled axles 120, 125 are connected to shoulder 148 on a side opposite the blade 150. Preferably, wheeled axle 120 includes opposing spaced apart wheels 132, 133 for improved stability. It may be appreciated that each wheel 132, 133 may connect with separate axles connecting to shoulder 148 for independent rotation.

Body member 115 is preferably aligned substantially between and above the wheels 132, 133 for centering or preferred balance of body member. It may be appreciated in further aspects that sliders 134 instead of wheels or wheeled axles may be used for self-standing configurations. Sliders 134 may be positioned at each of four corners of the shoulder 148 as shown in FIG. 10, and alternative slider arrangements including but not limited to those such as shown in FIG. 11 may be provided without detracting from the import of the invention. As shown in FIG. 6, shoulder 148 preferably includes a fender 151 which extends downward from the shoulder 148 and at least partially covers the wheel 132. Preferably, fender 151 is provided substantially around the entire perimeter of the shoulder 148. Fender 151 adds stability and protection to wheels 132, making it more difficult for removal of the wheels 132 from axles 120, 125, 130. It may be appreciated that multiple wheeled axles may be connected to shoulder 148 to accommodate desired stability and translational action of device 110, including a third wheeled axle 130 secured adjacent the front wheeled axle 120 and coplanar therewith.

Preferably, device 110 includes a handle 175 extending upwardly opposite the wheeled axle 120 or in the case where there is no wheeled axle, opposite the slider 134. A user may engage handle 175 to move device 110 about the surface to cut a sheet of material. A crossbar member 185 is preferably positioned perpendicularly to the body member 115 at the handle 175. Handle 175 may be bulbous in configuration or it may be of other varieties such as a post-like handle as shown in FIG. 6 for efficient engagement or grasping. Preferably, crossbar 185 is linear and is preferably removeably positioned on the handle. Preferably handle defines an aperture 190 to receive crossbar 185. Aperture 190 is preferably positioned near an end of the handle 175 opposite wheeled axle 120 or slider 134. Preferably crossbar 185 includes grooves 86 engageable with the aperture 190 to secure crossbar in a selected position. Groves 86 preferably consist of grooves circling the exterior of crossbar and configured to accommodate desired pre-set positions, including positioning of crossbar at a midpoint, at a left-side, or at a right-side of handle 175. Grooves 86 are configured to match with corresponding projection tabs 87 contained within aperture 190. Preferably, handle 175 is positioned opposite the cutting notch 135.

Handle 175 and body member 115 form an engaging notch 180 therebetween. As shown, engaging notch 180 is open ended. Engaging notch 180 allows a user to grasp handle 175 in a variety of positions, including insertion of fingers and palm within notch 180, or alternatively placing a palm on top of handle 175 while extending fingers downward into notch 180, or one of several other configurations depending on the ability and physical attributes of the user. In conjunction with a crossbar 185, configured perpendicular to handle 175, it can be appreciated that numerous hand-engaging arrangements can be utilized to allow a user to operate device 110. For instance, a user may wrap a finger (or thumb or more fingers) around crossbar 185 while wrapping a finger (or a thumb or more fingers) around handle 175 to grasp device 110. Notch 180 also provides further self-standing stabilizing action in that the center of gravity of device 110 is lower due to the absence of matter in the location of notch 180.

Figure 7:
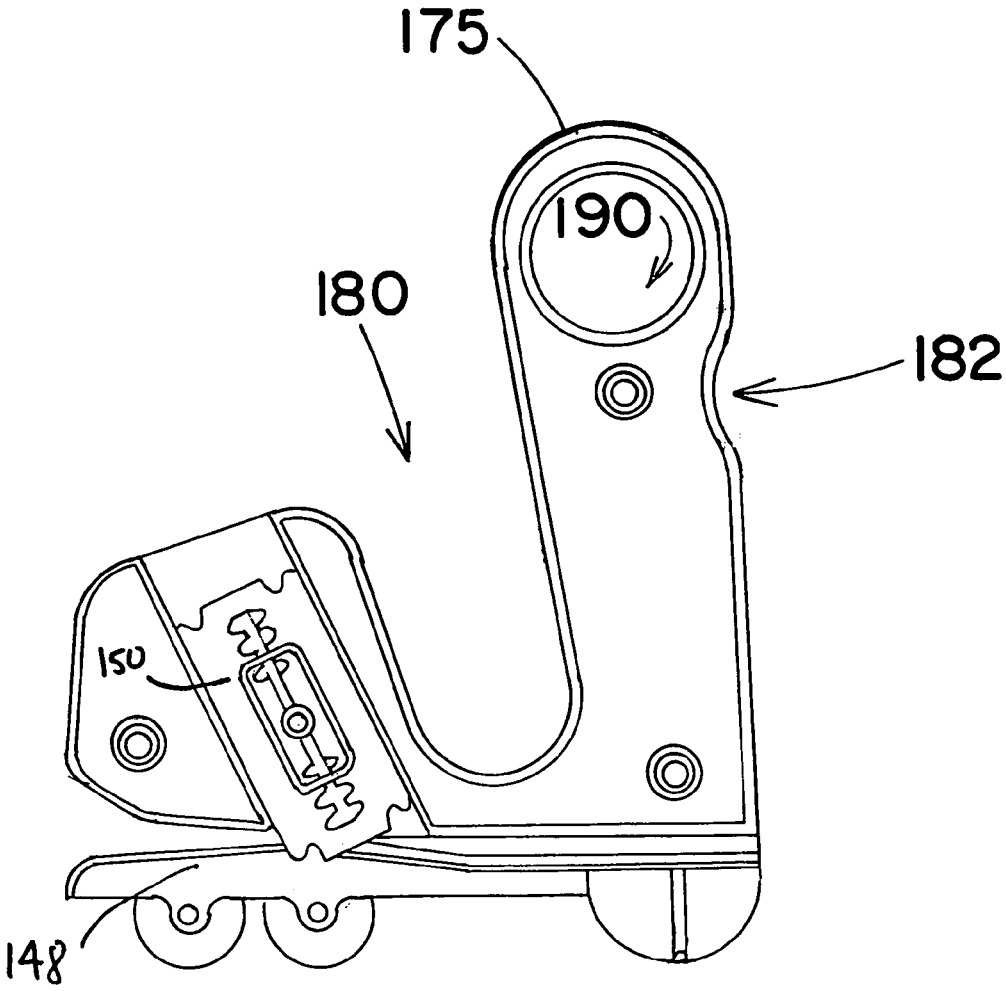
FIG. 7 shows a side view of the left side of the device shown in FIG. 6 having a potion of the device removed.
Figure 8:
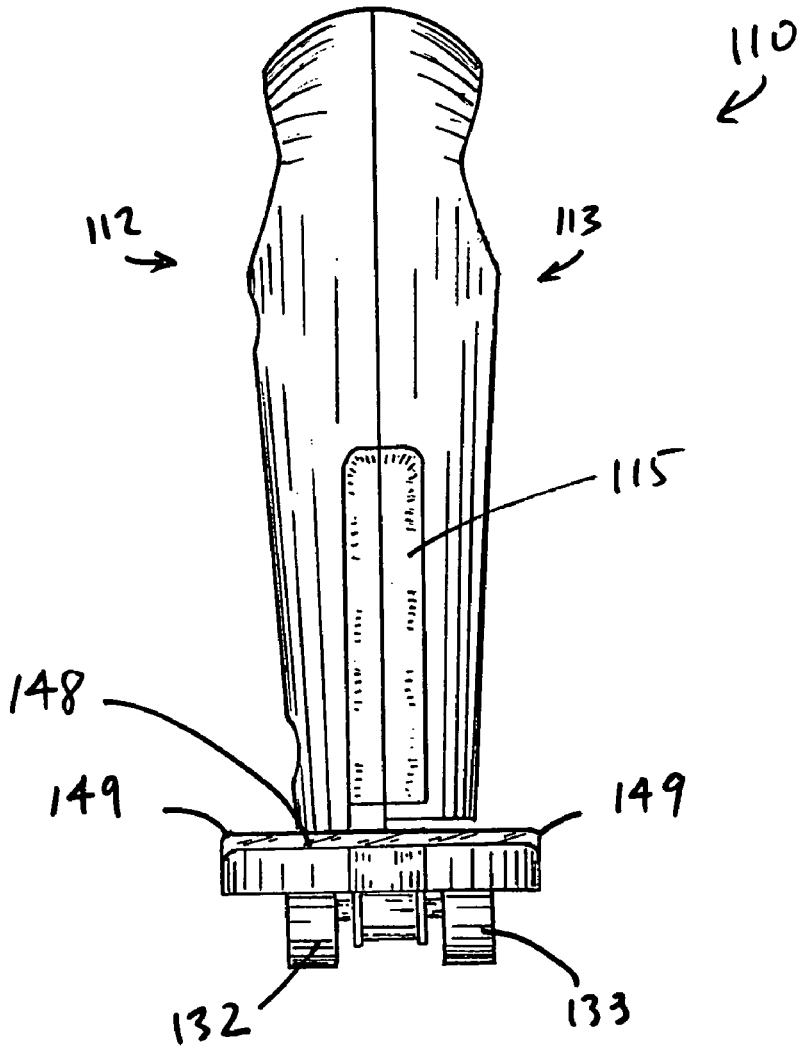
FIG. 8 shows a front elevation view of the device shown in FIG. 6.

As shown in FIG. 7, handle 175 also preferably includes a dimple 182 for receiving a finger, pointer (i.e., head or mouth pointer), or other item to releaseably engage handle 175 to move the device 110. Ideally, dimple 182 is in the form of a fingerprint or other depression to conveniently receive an engaging item, and dimple 182 is ideally located below the aperture 190 to provide effective and stable positioning during an engaging action. Preferably dimple 182 is located at a position lower than what is shown in FIG. 7 so as to inhibit tipping while moving the device. In operation, a user may push device 110 to cut sheet material by engaging the device with a head-pointer (such as at dimple 182 or other area) and moving device 110 forward. Thus, a user, without assistance, may independently cut flat sheet material without the need to operate complicated scissors or other cutting equipment. Device 110 is lightweight and dimensioned for generally table-top use. Device 110 is preferably made from plastic materials with a metal blade 150. Blade 150 is removable from body member 115, but is preferably securely fastened within body 115 with a screw 152. Preferably, blade cutting edge 155 is angled in the cutting notch 135 from the open end 140 toward the closed end 145. Preferably, blade 150 is positioned on a centerline of body member 115 which assist a user in visual alignment and control of the device for proper cutting.

Figure 9:
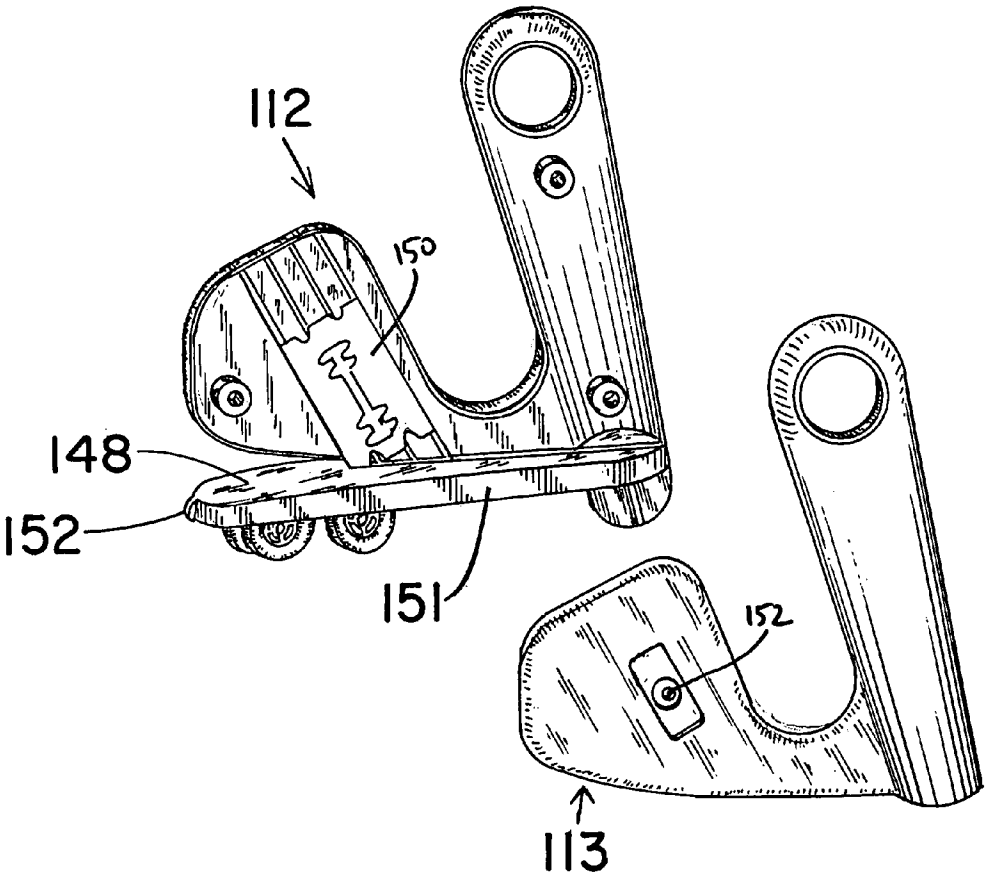
FIG. 9 shows an exploded perspective view of the device shown in FIG. 6.

As shown in FIG. 9, a left side piece 112 and right side piece 113 are provided. Ideally each piece 112, 113 is manufactured in a separate mold and joined together in common fashion. As shown, optional fender 151 protects wheels 132. Further, nose 152 extends from shoulder 148 in front of cutting notch 135 to urge sheet material into notch 135. Nose 152 may be extended to provide a variety of sheet pick-up configurations. As shown, a corner of blade 150 is preferably inset within shoulder 148 so as to provide improved fastening and safety of blade 150. Device 110 is self-standing in that no external support is required to allow device 110 to be oriented such that blade 150 is perpendicular to the surface upon which device 110 stands. Preferably, closed end of notch 145 measures approximately 3/32 of an inch in order to enhance safety aspects of the device 110.

Device 110 preferably includes spaced apart wheels 132, 133, or off-set or lengthened sliders (i.e. 134, 136, 138, 144, 146) so as to allow device 110 to self-stand while being moved about a surface. Spaced apart wheels provide a wider surface contact for overall stability of the device.

Further aspects of the invention are shown in FIGS. 10, 11, 12 and 13. Device 110 is a self-standing mobile device for cutting sheet material including a body member 115 defining a cutting notch 135 with open and closed ends 140, 145 and includes a contained cutting blade 150 with cutting edge 155 exposed within the cutting notch closed end 145. The cutting blade is oriented substantially vertically within body member 115. A shoulder 148 is positioned below the body member 115. The shoulder in part defines the notch 135. The shoulder has a width greater than a width of the body member 115. The shoulder translationally moves about a surface on which the device 110 stands.

Figure 12:
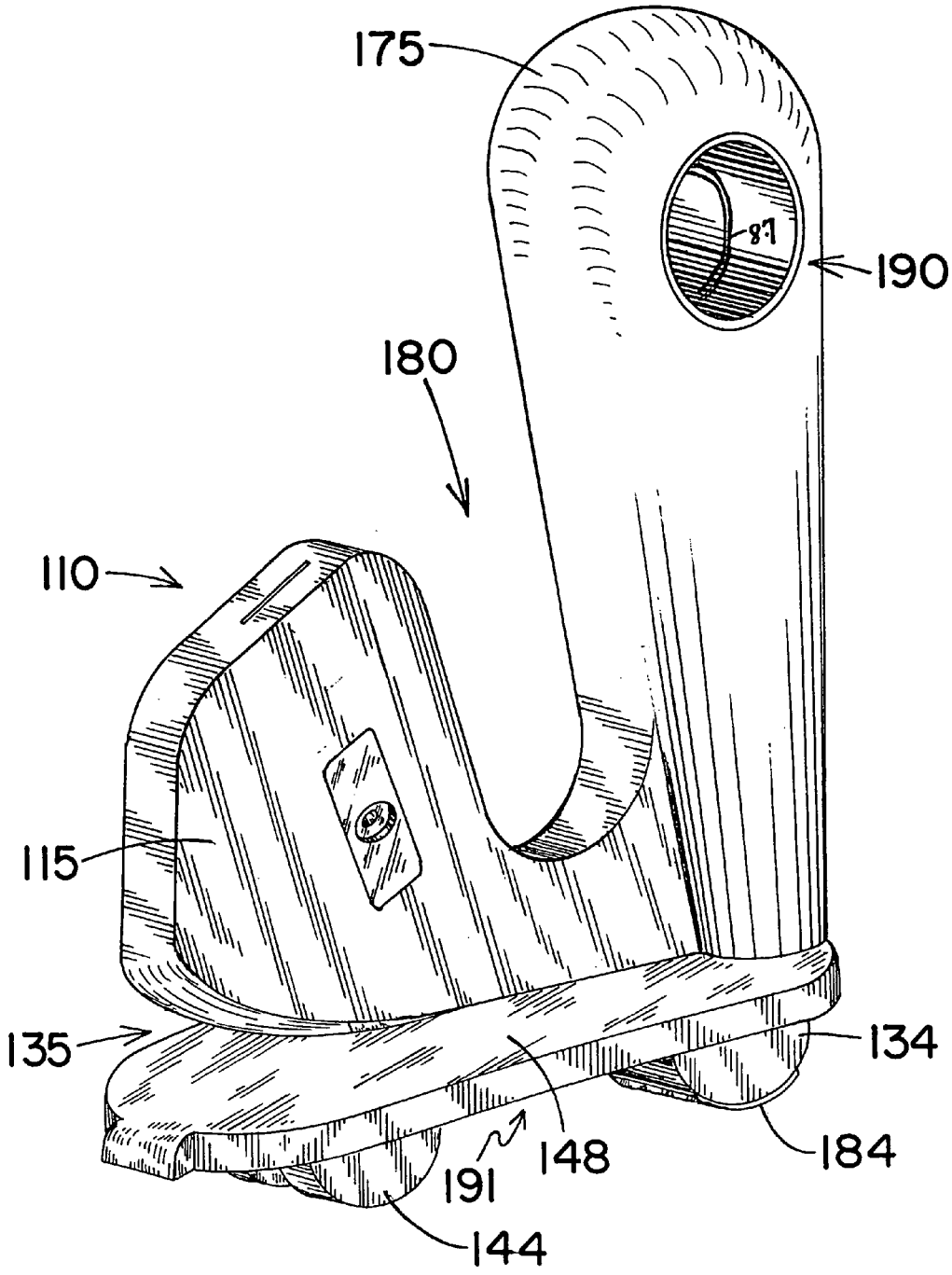
FIG. 12 shows a perspective view of the mobile cutting device for another embodiment of the present invention.
Figure 13:
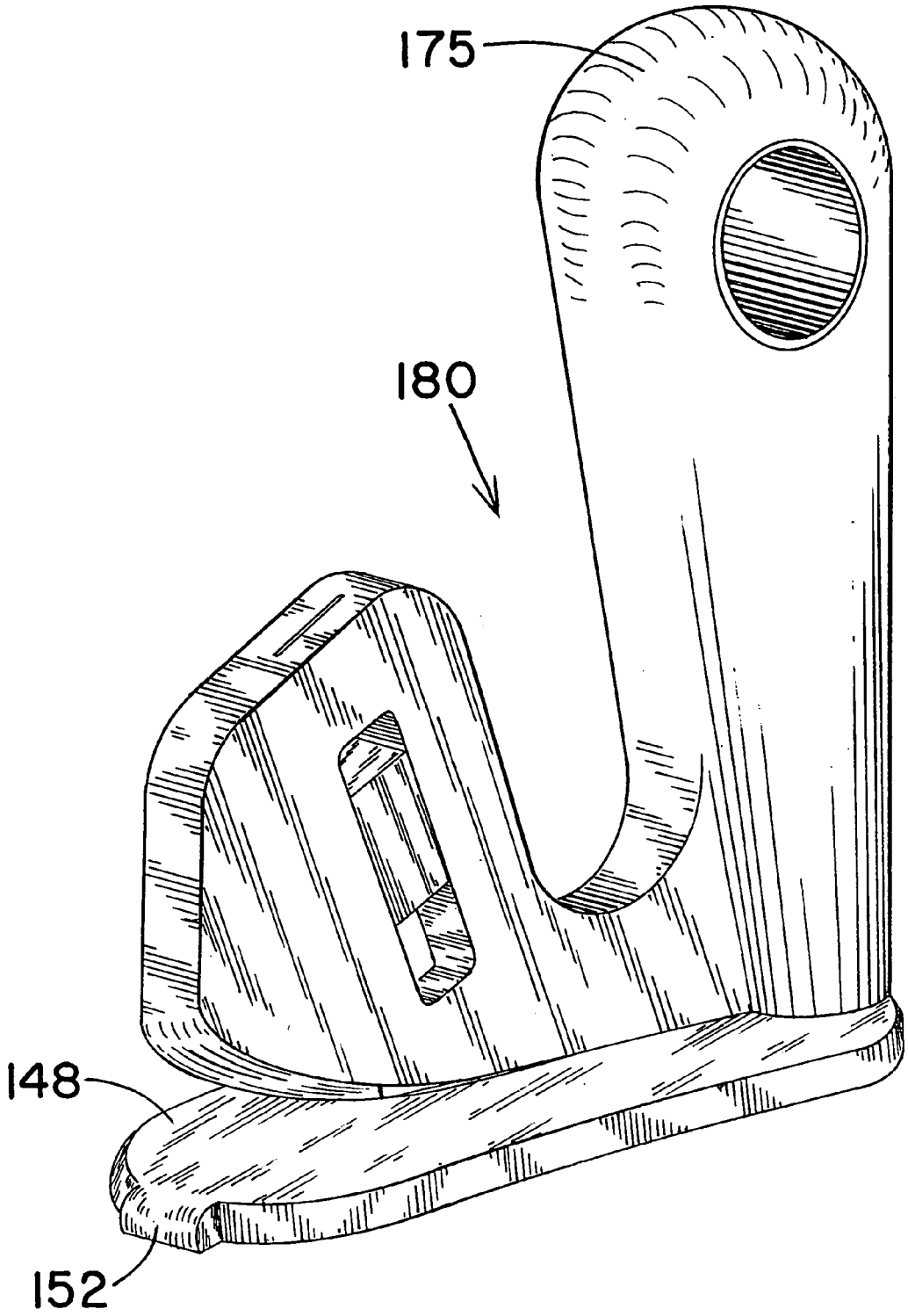
FIG. 13 shows a perspective view of the mobile cutting device for another embodiment of the present invention.
Figure 14:
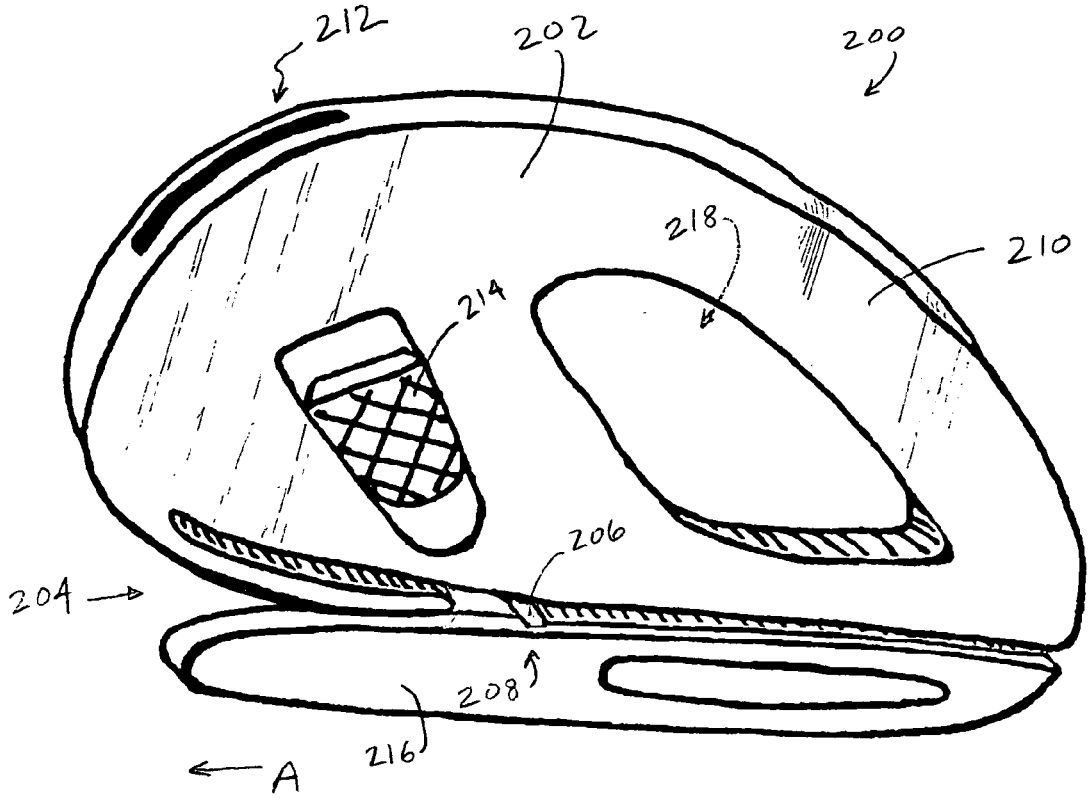
Figure 14 PRIOR ART
FIG. 14 shows a perspective view of a prior art coupon cutter device.
Figure 15:
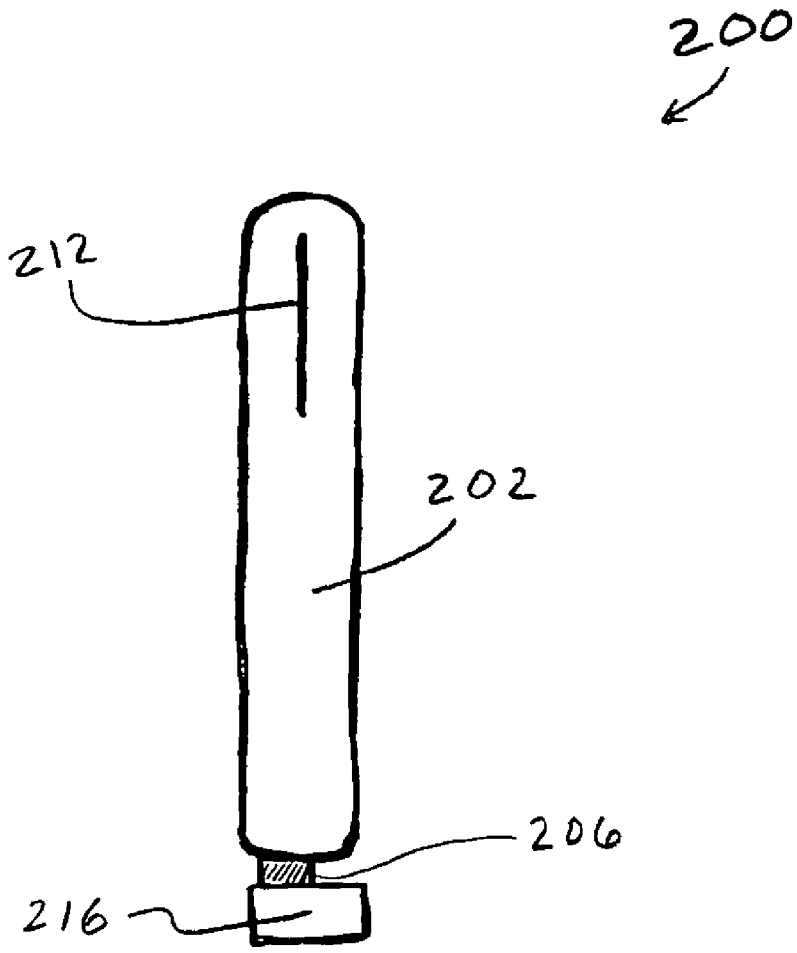
Figure 15 PRIOR ART
FIG. 15 shows a front view of the prior art coupon cutter device of FIG. 14.

As shown in FIG. 13, the shoulder 148 engages directly with the surface for movement, (i.e. shoulder 148 slides about the surface) while the invention as shown in FIGS. 10, 11 and 12 include at least one slider 134, 144. Shoulder 148 as shown in FIG. 11 may be narrowed, and while not shown in FIG. 11, can be extended to create a wide planar base to assist in positioning the sheet material and in providing self-standing stability. Device 115 of the present embodiment further includes a secured handle 175. Handle 175 extends upwardly opposite the surface. Handle 175 and body member 115 form an engaging notch 180. A user may thereby engage handle 175 in a variety of configurations to move device 110 about surface to cut a sheet of material. Preferably handle 175 is post-like and the cutting notch 180 is open-ended in that there is an absence of upper structure so that a user may place his or her hand or fingers easily into the notch with a downward motion while device 115 is self-standing. It may appreciate that a variety of sliders 134, 144, may be included such that sufficient stability of device 110 is achieved. A sliding medium such as a Teflon strip 184 may be provided at the engagement point of sliders 134, 144 as desired.

As shown in FIGS. 10, 11, 12, slider 134 and shoulder 148 define a clearance 191. Clearance 191 reduces contact between the bottom portion of shoulder 148 and the surface so that less friction is realized during operation to promote ease of motion. It may appreciated that device 110 includes at least one translational movement means positioned beneath shoulder 148. The translational movement means may include a slider, and/or various types of sliders, a roller, wheel, wheeled axle, track, contained sphere, bearing, Teflon strip, or other equivalent means employing equivalent results.

The invention further includes the method of operating the device according to the foregoing embodiments, including providing a device 10, 110 as described above, engaging the device 10, 110, and moving the device 10, 110 about the surface to cut a sheet material passing into the cutting notch 35, 135. The method is particular useful for those having difficulty operating traditional cutting devices, scissors, and the like.

The descriptions above and the accompanying drawings should be interpreted in the illustrative and not the limited sense. While the invention has been disclosed in connection with the preferred embodiment or embodiments thereof, it should be understood that there may be other embodiments which fall within the scope of the invention as defined by the following claims. Where a claim is expressed as a means or step for performing a specified function it is intended that such claim be construed to cover the corresponding structure, material, or acts described in the specification and equivalents thereof, including both structural equivalents and equivalent structures.

We claim:

1. A self-standing mobile device for cutting sheet material comprising;

a body member connected to at least one wheeled axle to translationally move said body member about a surface on which said device self-stands;

said body member including a cutting notch with open and closed ends, said cutting notch positioned with said open end above said at least one wheeled axle;

said body member including a contained cutting blade member with cutting edge exposed within said cutting notch closed end, said cutting blade member oriented substantially perpendicularly to the surface on which said device self-stands;

whereby a user engages said device to move said device about the surface on the at least said one wheeled axle to cut a sheet of material passing into said cutting notch.

2. The mobile device for cutting sheet material according to claim 1 wherein said body member is a planar member connected substantially perpendicularly with said wheeled axle and said blade member is oriented substantially perpendicular with respect to said wheeled axle.

3. The mobile device for cutting sheet material according to claim 2 wherein said device includes a shoulder positioned below said body member, said shoulder in part defining said notch and having a width greater than a width of said body member, and wherein said wheeled axle is connected to said shoulder opposite said cutting blade.

4. The mobile device for cutting sheet material according to claim 3 wherein said wheeled axle includes two opposing wheels, and wherein said body member is aligned substantially between and above said wheels.

5. The mobile device for cutting sheet material according to claim 4 wherein said shoulder includes a fender extending downward and at least partially covering said wheels.

6. The mobile device for cutting sheet material according to claim 5 wherein said fender is provided substantially around the entire perimeter of said shoulder.

7. The mobile device for cutting sheet material according to claim 2 wherein said device includes at least two wheeled axles each positioned in a plane and oriented substantially perpendicularly to said planar body member.

8. The mobile device for cutting sheet material according to claim 7 further comprising a third wheeled axle secured perpendicularly to said body member adjacent said front wheeled axle and coplanar therewith.

9. The mobile device for cutting sheet material according to claim 7 wherein, said cutting notch is essentially parallel to said plane of said wheeled axles.

10. The mobile device for cutting sheet material according to claim 1 further comprising a handle secured to said device, said handle extending upwardly opposite said at least one wheeled axle, whereby a user engages said handle to move said device about the surface on the at least said one wheeled axle to cut a sheet of material passing into said cutting notch.

11. The mobile device for cutting sheet material according to claim 10 further comprising a crossbar member positioned perpendicularly to said body member at said handle.

12. The mobile device for cutting sheet material according to claim 11 wherein, said crossbar member is linear and is removeably positioned in an aperture defined by said handle.

13. The mobile device for cutting sheet material according to claim 12 wherein, said crossbar includes grooves engageable with said aperture to secure said crossbar in a selected position.

14. The mobile device for cutting sheet material according to claim 10, wherein said handle is positioned opposite said cutting notch, and said handle and said body member form an engaging notch there between.

15. The mobile device for cutting sheet material according to claim 12 wherein, said handle aperture is positioned near an end of said handle opposite said wheeled axle, and wherein said handle includes a dimple.

16. The mobile device for cutting sheet material according to claim 1 wherein, said contained cutting blade member is removable from said body member.

17. The mobile device for cutting sheet material according to claim 1 wherein, said contained cutting blade member is positioned approximately on a centerline of said body member.

18. The mobile device for cutting sheet material according to claim 1 wherein, said device includes a surface-contacting slider positioned below said cutting notch.

19. The mobile device for cutting sheet material according to claim 1 wherein, said cutting notch is tapered substantially from said open end to said closed end.

20. A self-standing mobile device for cutting sheet material comprising;

a planar body member connected to at least one wheeled axle to self-stand and translationally move said body member about a surface on which said device self-stands;

said body member including a tapered cutting notch with open and closed ends, said notch positioned with said open end above said at least one wheeled axle;

said body member including a contained cutting blade member with cuffing edge exposed within said cutting notch closed end, said cutting blade oriented substantially perpendicular to the surface;

a shoulder positioned below said body member, said shoulder in part defining said cutting notch and having a width greater than a width of said body member; and a handle secured to said body member, said handle extending upwardly opposite said at least one wheeled axle, whereby a user engages said handle to move said device about the surface on the at least said one wheeled axle to cut a sheet of material passing into said cutting notch.

21. A self-standing mobile device for cutting sheet material comprising;

a body member including a cutting notch with open and closed ends and including a contained cutting blade member with cutting edge exposed within said cutting notch closed end, said cutting blade oriented substantially vertically within said body member, said body member having a body member width;

a shoulder positioned below said body member and having a shoulder width greater than said body member width, said shoulder in part defining said notch; said shoulder translationally moveable about a surface on which said device self-stands; and a handle secured to said device, said handle extending upwardly opposite the surface, said handle and body member forming an engaging notch therebetween, whereby a user engages said handle to move the body member about the surface to cut a sheet of material passing into said cutting notch.

22. The mobile device for cutting sheet material according to claim 21 wherein said handle is a post-like handle positioned opposite said cutting notch open end, and said engaging notch is open-ended.

23. The mobile device for cutting sheet material according to claim 21 further comprising a crossbar member positioned perpendicularly to said body member at said handle.

24. The mobile device for cutting sheet material according to claim 21 wherein, said handle defines an aperture for receiving a crossbar member.

25. The mobile device for cutting sheet material according to claim 21 wherein said shoulder has a width greater than a width of said body member and wherein said shoulder directly abuts the surface.

26. The mobile device for cutting sheet material according to claim 21 further comprising at least one surface slider positioned beneath said shoulder, said slider moveably abutable with the surface.

27. The mobile device for cutting sheet material according to claim 26 wherein said surface slider, said shoulder, and the surface define a clearance.

28. The mobile device for cutting sheet material according to claim 21 further comprising at least one translational movement means positioned beneath said shoulder.

29. The mobile device for cutting sheet material according to claim 28 wherein said translational movement means includes at least one wheeled axle.

30. The mobile device for cutting sheet material according to claim 21 wherein, said body member is planar and vertically mounted on said shoulder, and said contained cutting blade is positioned on a centerline of said planar body member.

31. The mobile device for cutting sheet material according to claim 21 wherein, said handle includes a dimple.

32. A method of cutting sheet material including the steps comprising:

providing a self-standing mobile device, said device comprising:

a body member including a cutting notch with open and closed ends and including a contained cutting blade member with cutting edge exposed within said cutting notch closed end, said cutting blade oriented substantially vertically within said body member, said body member having a body member width;

a shoulder positioned below said body member and having a shoulder width greater than said body member width, said shoulder in part defining said notch; said shoulder translationally moveable about a surface on which said device self-stands; and a handle secured to said device, said handle extending upwardly opposite the surface, said handle and body member forming an engaging notch therebetween;

engaging said device; and moving said device about the surface to cut a sheet of material passing into said cutting notch.

33. A method of cutting sheet material according to claim 32 wherein said shoulder includes translational movement means positioned beneath said shoulder.

34. A method of cutting sheet material according to claim 33 wherein said translational movement means is spaced apart a dimension greater than a width of said body member to accommodate self-standing of said device while moving said device.

35. A method of cutting sheet material according to claim 32 wherein said shoulder has a width greater than a width of said body member.

* * * * *